United States Patent [19]

Aubin et al.

[11] Patent Number: 4,757,314

[45] Date of Patent: Jul. 12, 1988

[54] APPARATUS FOR THE CONTROL AND MONITORING OF A WELL HEAD SUBMERGED IN A LIQUID

[75] Inventors: Christophe Aubin, Pau; Marc Perrot, Randaberg; Claude Sesques, Pau, all of France

[73] Assignee: Societe Nationale Elf Aquitaine (Production), Paris, France

[21] Appl. No.: 863,514

[22] Filed: May 15, 1986

[30] Foreign Application Priority Data

May 15, 1985 [FR] France ..... 85 07411

[51] Int. Cl.[4] ..... G01V 1/00

[52] U.S. Cl. ..... 340/856; 364/422; 166/66

[58] Field of Search ..... 340/853, 856, 858, 850; 364/422; 166/66, 66.4, 250, 335, 336

[56] References Cited

U.S. PATENT DOCUMENTS

| | | | |
|---|---|---|---|
| 4,052,703 | 10/1977 | Collins, Sr. et al. . | |
| 4,352,376 | 10/1982 | Norwood | 166/53 |
| 4,375,239 | 3/1983 | Barrington et al. | 166/66.4 |
| 4,410,038 | 10/1983 | Drapp | 166/53 |
| 4,631,536 | 12/1986 | Ward et al. | 340/858 |
| 4,636,934 | 1/1987 | Schwendemann et al. | 364/422 |

OTHER PUBLICATIONS

L'Industrie Du Petrole, vol. 50, No. 540, Jan. 1982, pp. 34–39, Paris, FR; D. Paulluat: "Systeme de Controle du BOP et du Tube Prolongateur".

Oil & Gas Journal, vol. 77, No. 18, Apr. 1979, pp. 174, 175, 177 and 178, Tulsa, U.S.; B. G. Tompkins: "Programmable Controllers Go Offshore".

*Primary Examiner*—Charles T. Jordan
*Assistant Examiner*—John W. Eldred
*Attorney, Agent, or Firm*—Oblon, Fisher, Spivak, McClelland & Maier

[57] ABSTRACT

The invention relates to an apparatus for the control and monitoring of a well head submerged in a liquid.

The apparatus comprises electrovalve control means, an electronic system for controlling and monitoring the well head, monitoring sensors, connecting means connected to the electronic system and a station on the surface of the liquid medium using a transmission line. The electronic system comprises a first channel connected to the control means and to the sensors, supplied with electric power by the line and a second channel for controlling the control means and which is supplied with electric power by said line. The second channel and the electrovalve control means are also connected to an autonomous power supply, which is independent of the line. Each of the channels and the connection established bidirectional communications with the station.

Application to the control and monitoring of submerged well heads.

3 Claims, 4 Drawing Sheets

APPARATUS FOR THE CONTROL AND MONITORING OF A WELL HEAD SUBMERGED IN A LIQUID

BACKGROUND OF THE INVENTION

The present invention relates to an apparatus for the control and monitoring of a well head submerged in a liquid. It applies to the control of the opening or closing of submerged well head valves and in particular those of oil or gas well heads, as well as to the monitoring of these well heads.

For various reasons, the valves of submerged or immersed well heads must be openable or closable at all times and it must be possible, for production and safety reasons, to check said opening or closing. Generally the opening or closing of well head valves is controlled by electrovalves, which are themselves submerged and controlled by an electrical or electronic system or unit, which is also submerged. This electrical or electronic system is contained in a tight enclosure and is connected to a station on the surface of the liquid medium by an electric signal transmission line. This line transmits to the electronic system and to the electrovalves, the electric signals necessary for supplying them with power. It also supplies electric or electronic system control signals for controlling the opening or closing of the electrovalves, as well as test signals for the system. This line transmits to the surface station signals resulting from the test signals, as well as measuring signals relating to parameters concerning the monitoring of the operation of the well head, said signals being supplied by sensors.

The direct control of the opening or closing of the valves from a station located on the surface of the liquid medium and which transmits control signals to the electronic system by a transmission line, such as e.g. a cable, suffers from disadvantages. If the cable breaks, it is no longer possible to check the electrovalves and therefore the opening or closing of the well head valves. in known control and monitoring apparatuses, most of the control and monitoring operations are performed from the station on the surface of the liquid medium. The electronic or electric system for controlling the electrovalves in fact only serves as an interface making it possible to transmit valve opening or closing control instructions supplied by the station or for transmitting to the station the results of measurements performed by the sensors, said results being processed by a system within the station.

In the case of an incident detected on the basis of these results, in most known apparatuses it is only the actual station which controls the closing of the valves by signals transmitted by the line. This is a serious disadvantage, particularly in the case of the breaking of the line connecting the electronic system to the surface station. In the known apparatuses, the electronic system is not programmable and the controls are essentially transmitted from the surface. However, for the electronic systems of the known apparatuses, there are means making it possible to automatically act on the electrovalves in the case of a line break, but said means are not programmable.

Thus, the automatic closure of the valves can be brought about by a complete breaking of the line, but also by simple transmission incidents on said line and which are likened to a break.

SUMMARY OF THE INVENTION

The object of the present invention is to obviate these disadvantages and in particular provide a monitoring and control device for a well head which, although connected to a surface station by a transmission line for electric signals, can operate autonomously in the case of the line breaking, in order to process data resulting from signals supplied by the sensors, without it being necessary to transmit said data across the line and is able to supply controls without it being necessary to transmit these across the line. This programmable apparatus can function autonomously in the case of the line breaking.

The present invention specifically relates to an apparatus for the control and monitoring of a well head submerged in a liquid comprising, in a tight submerged enclosure, means for controlling electrovalves for controlling the opening or closing of well head valves, an electronic system for controlling and monitoring the well head connected to the electrovalve control means and to submerged monitoring sensors, connecting means connected to the electronic system and to a control and monitoring station on the surface of the liquid medium by a transmission line, which supplies to the connecting means electric power supply signals for the electronic system and for the electrovalve control means, control signals for the electrovalve control means and test signals for the electronic system, said line transmitting to the station the signals resulting from these tests, wherein the electronic control and monitoring system comprises two checking channels, the first of these channels being a control and monitoring channel connected to the electrovalve control means and to the sensors, said first channel being supplied with electric power by connecting means, which are themselves supplied by the line connected to the station, the second channel being a control channel for the electrovalve control means, said second channel being supplied with electric power by connecting means, which are themselves supplied by the line, said second channel and the electrovalve control means being also connected to an autonomous electric power supply source, which is independent of said line and contained in said enclosure, each of the channels, as well as the connection being able to establish bidirectional communications with the station.

According to another feature, the connecting means comprise an interface connected to the two checking channels and modulators-demodulators or modems connected to said interface and to a separator circuit, which is itself connected to the transmission line, said circuit separating the electric power supply signals and the different signals transmitted by the station to the two checking channels, a mixer circuit connected to the modems of the two channels and to the transmission line, said circuit mixing the signals transmitted by the two channels to the station and supply means connected to the separator for receiving the electric power supplied by the line and connected to the modems, at the interface, to the two channels, as well as to the electrovalve control means for supplying them with electric power.

According to another feature, the first channel comprises a first computer connected to a first memory, to the sensors by means for the acquisition of the signal supplied by said sensors, to the electrovalve control means, to the interface and to the electric power supply means, the second channel incorporating a second computer connected to a second memory, to the electrovalve control means, to the interface and to the electric power supply means, said second computer, as well as the electrovalve control means also being connected to the autonomous electric power source independent of the electric power supplied by said line.

According to another feature, the memories of the first and second computers contain programs or microprograms for controlling the transmission of the control, monitoring and test signals between the computers and the station and for triggering an alarm in the case of a transmission problem.

According to another feature, the memory of the second computer also contains a safety or security program or microprogram, so that the second computer initiates a predetermined valve closure procedure in the case of a transmission problem in the connecting means, or a failure of said connecting means to operate, or the breaking of the line.

According to another feature, said second computer periodically receives from said station, signals for initializing a regulatable count down, the safety program or microprogram initiating the closure of the valves when the second computer has not received further initialization signals prior to the end of one of said periods.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
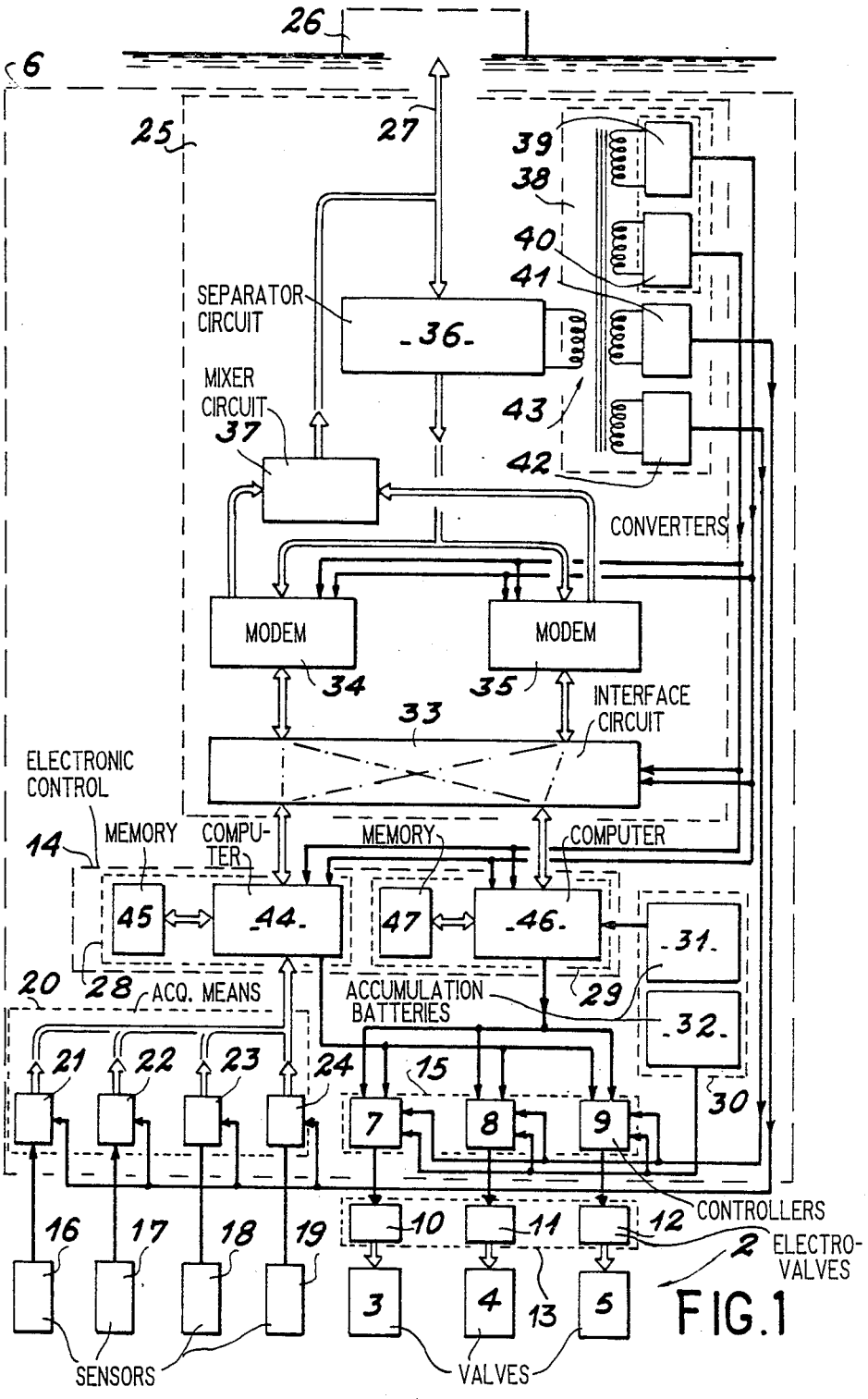
FIG. 1, diagrammatically an apparatus according to the invention.

FIG. 1 diagrammatically shows an apparatus for the control and monitoring of a well head 2, more particularly constituted by valves 3, 4, 5, submerged in a liquid, such as e.g. lake water or ocean water. This apparatus is contained in a tight enclosure 6 shown diagrammatically in the drawing. It comprises a group 15 of means 7, 8, 9, for controlling electrovalves 10, 11, 12 contained in an enclosure 13 and respectively connected to valves 3, 4, 5 for controlling their opening or closing. Preferably, the pressure within the enclosure 6 is equal to atmospheric pressure, whilst the pressure enclosure 13 is that of the external medium, i.e. the liquid. This arrangement is e.g. described in French patent application No. 8419453, filed on Dec. 19, 1984 in the name of the present Applicant. The electrovalve control means 7, 8, 9 are not described in detail here and can e.g. be constituted by bistable electronic means controlling the electrovalves. Each of the electrovalves, which are not shown in detail here, essentially comprises control solenoids, as will be shown in greater detail hereinafter, making it possible to open or close said electrovalves. In the tight enclosure 6, apparatus 1 also comprises an electronic system 14 for controlling and monitoring the well head. This electronic system 14 is connected to the electrovalve control means 15, as well as to submerged monitoring sensors 16, 17, 18, 19. The electronic system 14 will be described in greater detail hereinafter. The sensors supply the electronic system 14 with signals representing the values of parameters making it possible to monitor the operation of the well head. For example, these parameters can be the flow rate of the liquid or gaseous fluid circulating in the well head, the pressure of said fluid, its temperature, the external pressure, etc. Sensors 16, 17, 18, 19 can be connected to electronic control means 14, e.g. by means 20 for the acquisition of signals supplied by the sensors. The acquisition means 21, 22 connected to sensors 16, 17 can e.g. be of the analogue type, whilst the acquisition means 23, 24 connected to sensors 18, 19 can be of the digital type.

The apparatus also comprises connecting means 25 connected to the electronic system 14 and to a monitoring and control station 26 on the surface of the liquid medium. The connecting means 25 are connected to station 26 by a transmission line 27 which supplies connecting means 25 with electric power supply signals for the electronic system 14 and for the electrovalve control means 15, together with the sensor group 20. As will be shown hereinafter, the transmission line also supplies test signals for the electronic system 14 and control signals for the electrovalves. It transmits to the station 26, via connecting means 25, signals resulting from said tests. The communications in line 27 and in connecting means 25 are of the bidirectional or full-duplex type. Line 27 is e.g. a coaxial cable.

The electronic system 14 comprises two checking channels 28, 29, which will be described in greater detail hereinafter. The first channel 28 is a control and monitoring channel connected to the electrovalve control means 15 and to the sensors 16 to 19 via acquisition means 21 to 24. The first channel is supplied with electric power by connecting means 25, which are themselves supplied by station 26 via line 27. The second channel 29 is a control channel for the electrovalve control means 15. The second channel is supplied with electric power by connecting means 25, which are themselves supplied by station 26 via line 27. This second channel and the electrovalve control means 15 are also connected to an autonomous electric power supply source 30, which is independent of line 27 and contained in tight enclosure 6. This autonomous source can e.g. be constituted by two accumulator batteries 31, 32, respectively supplying the second channel 29 and the electrovalve control means 15.

Connecting means 25 comprise an interface 33 connected to the two channels 28, 29, as well as modems connected to said interface. In the present embodiment, the number of modems has been limited to two. A separator circuit 36 (such as e.g. a filter) is connected to modems 34, 35 for separating the electric supply signals of the apparatus components from the different signals transmitted by station 26 to the two checking channels. The connecting means also comprises a mixer circuit 37 connected to the two modems 34, 35 for mixing the signals transmitted by the two modems 34, 35 to station 26 via line 27. Finally, the connecting means 25 comprise supply means 38 connected to separator 36 for receiving therefrom the electric power supplied by the line. The supply means 38 are connected to the modems 34, 35, to the interface 33, to the two checking channels 28, 29, to the acquisition means 20 of the signal supplied by the sensors, as well as to the electrovalve control means 15 for supplying them with electric power. These supply means are in fact constituted by a.c.-d.c. converters 39, 40, 41, 42, which receive an alternating current transmitted by line 26 via separator 36 and which respectively supply direct currents at there outputs. The alternating current is applied to the inputs of the converters by a transformer 43, whereof a primary winding is connected to an output of the separator and whereof the secondary windings are connected to the inputs of converters 39 to 42.

The first channel 28 comprises a first computer 44 connected to a first memory 45. This first computer is also connected to the acquisition means 21 to 24 of the analogue or digital signal supplied by sensors 16 to 19. Outputs of the first computer are also respectively connected to the control means 7, 8, 9 of electrovalves 10, 11, 12. Inputs-outputs of said computer are connected to interface 33. The computer is also connected to electric power supply means 39, 40, which are redundant for safety reasons and also supply the interface 33 and modems 34, 35. Supply means 41 supply the control means 7, 8, 9 of electrovalves 10, 11, 12.

The second channel 29 comprises a second computer 46 connected to a second memory 47. This computer is also connected by out puts to the control means 7, 8, 9 of electrovalves 10, 11, 12, inputs-outputs of said computer being connected to interface 33. The second computer 46 and the electrovalve control means 7, 8, 9 are connected to the autonomous power supply 30, which is independent of the electric power supplied by line 27, as well as to the supply means 38. Computer 46 and control means 7, 8, 9 for the electrovalves can consequently be supplied by the accumulator batteries 31, 32 in the case of line 27 breaking.

The memories 45, 47 of the first and second computers 44, 46 contain, as will be shown hereinafter, programs or microprograms for the transmission control of the control, monitoring and test signals exchanged between the computers 44, 46 and station 26 via connecting means 25 or line 27. These programs or microprograms in particular make it possible to trigger an alarm in the case of a message transmission problem between station 26 and computers 44, 46.

The memory 47 of the second computer particularly contains a predetermined safety program or microprogram, so that the second computer initiates the closure of the valves in the case of a transmission in connecting means 25, or in the case of the connecting means not operating, or in the case of line 27 breaking, said computer then being supplied in an autonomous manner by supply means 30. This program or microprogram can also intervene during certain well head maintenance operations.

As will be shown in greater detail hereinafter, the second computer periodically receives from station 26 via line 27 and the connecting means 25, regulatable countdown initialization signals. The safety program or microprogram initiates the closure of the valves when said second computer has not received a new initialization signal before the end of one of the counting periods.

The first control and monitoring channel 28 constitutes the main channel of the apparatus. As will be shown hereinafter, it makes it possible to control the dialogue with the surface station 26, the electrovalve control, as well as the digital and analogue acquisitions. The second channel 29 constitutes a reduced configuration secondary channel, which permanently maintains a watch status and which is activated in the case of a failure on the main channel, so as to permit the complete apparatus to continue to operate in a degraded mode. The only functions of the secondary channel are the control of the dialogue with the surface and the control of the electrovalves in the case of the breaking or problems on the connection 27 or an operating problem relative to the connecting means 25 or the main channel 28. Each of the computers can communicate with the surface via connecting means 25, in a full-duplex-type communication. This can be established across interface 33 by one or other of the modems 34, 35 and by the mixer 37. A fault in one of the modems does not block the communication of each of the computers with the surface station. The essential communication protocols between the surface station and the control and monitoring channels will be described hereinafter.

The electrovalve used are of the bistable hydraulic locking type and more particularly comprise two control solenoids for each of their stable positions. One of the two solenoids is controlled e.g. by computer 44, whilst the other solenoid is controlled by computer 46. This redundancy assists the safety or security of the apparatus. Thus, each electrovalve has four solenoids (two solenoids per stable position). Thus, the second channel 29 maintains a permanent watch and is only activated by a specific message retransmitted on line 27 in the case of a failure of the first channel. The surface station, which is not described in detail here, obviously comprises data transmission and reception means, data processing means, as well as alternating current supply means. The redundancy of the main components of the apparatus (computers, supplies, modems), as well as the presence of autonomous electric supplies enable the apparatus to act in a safety sense in the case of an incident necessitating the closure of the well head valves. As will be shown in greater detail hereinafter, this making safe is timed on the basis of instructions transmitted by the surface station, even if line 27 breaks. The drawing does not show the supply of a control fluid to the electrovalves. This supply can either be a submerged autonomous source in the vicinity of the electrovalves, or a hydraulic connection connecting these electrovalves to the surface station.

Figure 2:
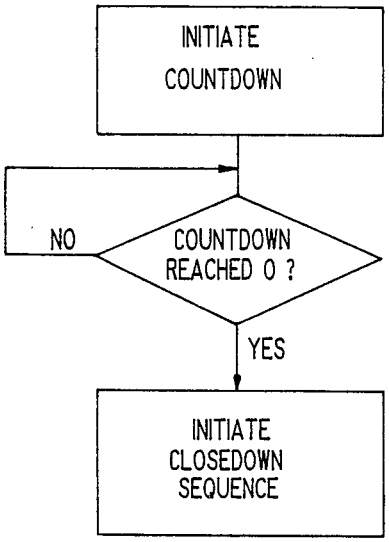
FIG. 2, a flow chart showing the valve closure control operations in the case of an incident or the breaking of the line connecting the apparatus to the surface station.

FIG. 2 is a flow chart showing the valve closure control operations in the case of an incident, e.g. in the case of line 27 breaking. These operations are in fact performed by computer 46 of the second channel 29. They essentially comprise a countdown performed by the second computer 46 and periodically initiated from station 26 before each count reaches the value 0. Thus, the making safe of the well (closure of the valves by controlling the electrovalves) in accordance with a sequence preprogrammed into memory 47 of the second computer 46 takes place in the following way. Surface station 26 transmits via line 27 and connecting means 25 a signal for loading a predetermined value into a countdown counter of computer 46 to the later. This predetermined value, which is periodically reloaded, can be fixed or varyable as a function of the given requirements of station 26. If the countdown does not reach the value 0 before the reloading of the counter (before the end of the counting period), a new countdown is initiated. However, if the countdown does reach the value 0 at the end of a counting period before the loading of a new counting value, it is because an incident has occurred on line 27 or in connecting means 25, or because station 26 has not transmitted a countdown loading instruction for maintenance reasons. The second computer 46 then initiates, via control means 15, the closure of valves 2 controlled by electrovalves 13.

Thus, the making safe of the well, in accordance with a preprogrammed sequence, can be delayed at random when the connection is deliberately interrupted. This, is, for example, the case when the station 26 wishes to carry out maintenance operations in the surface station or testing operations in general. This countdown system permits a maintenance intervention on the well head or surface station of a long duration, when the counter has been loaded with a high value corresponding to the planned duration of this intervention. During this interruption, which is not caused by the breaking of the line, computer 46 of the second checking channel makes it possible to continue oil or gas production because, in this case, the valves do not have to be closed. The apparatus, which comprises an autonomous power supply 30, also makes it possible to overcome the consequences of a brief interruption of the power supply from station 26.

Thus, the making safe of the well head takes place according to a programmed sequence which is specific to the well in question and specific to the operating procedures of said well. This preprogrammed sequence is e.g. written in a definitive manner into the computer memory, which can at least partly be a ROM. This preprogrammed valve closing sequence then makes it possible to stop production under conditions not disturbing the reopening of the valves following said interruption.

FIGS. 3A, 3B, 3C, and 3D are flow charts providing a better understanding of the carrying out of an instruction by the electronic control means 14, on the basis of a message transmitted on line 27 by station 26.

The performance of an instruction, on the basis of a message supplied by the surface station 26, requires four major stages subdivided into several operations shown on the flow charts of FIGS. 3A, 3B, 3C, and 3D. In the latter, the terms "channel", or "channel 1" or "channel 2" designate the remote transmission channels, which must not be confused with the first and second checking channels 28, 29 referred to hereinbefore and which are essentially constituted by computers 45, 46, their associated memories 44, 47, the acquisition means 20 and the electrovalve control means 15. Each of the modems 34 or 34 realises two remote transmission channels, one in the sense of the submerged apparatus to the surface station and the other in the sense of the surface station to the submerged apparatus. Thus, there are four possibilities foe establishing a full-duplex communication between the surface station and the submerged apparatus. If "fall" is used to designate a transmission from the station to the submerged apparatus and "rise" a transmission from the submerged apparatus to the surface station, these four possibilities are as follows:

fall by modem 34 and rise by modem 34,
fall by modem 34 and rise by modem 35,
fall by modem 35 and rise by modem 35
fall by modem 35 and rise by modem 34.

These four possibilities are available to each of the computers 44 and 46.

Firstly, station 27 which has to transmit to the electronic control and monitoring means a message permitting the performance of an order, will test the first communication possibility, in the case of a failure of the first possibility it will test the second possibility and so on. In the case of a simultaneous failure of the four communication possibilities, an alarm will be given in the station. The is what is shown in flow chart of FIG. 3A. The station firstly transmits a message on the first fall station (e.g. of modem 34) and requests a reply on the first rise channel. if the reply supplied by the electronic control and monitoring means 14 is correct, the message is processed by means 14. However, if the reply from the electronic means 14 for the transmission of the message on the first rise channel is incorrect, said message will be retransmitted according to one of the three remaining transmission possibilities and then the procedure will recommence in the same way. If the reply is then correct, the message is processed. However, if the reply is incorrect and if the four communication possibilities have already been tried out, an alarm is given by the surface station to indicate that it is impossible to communicate on all four channels.

Figure 3A:
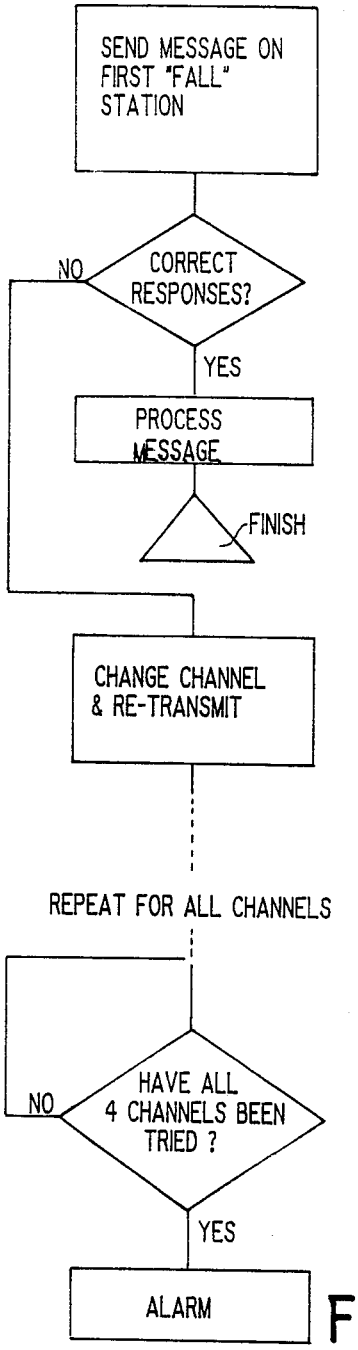
FIGS. 3A, 3B, 3C, 3D flow charts providing a better understanding of the different operations performed during the transmission of an instruction to the electronic system from the surface station.
Figure 3B:
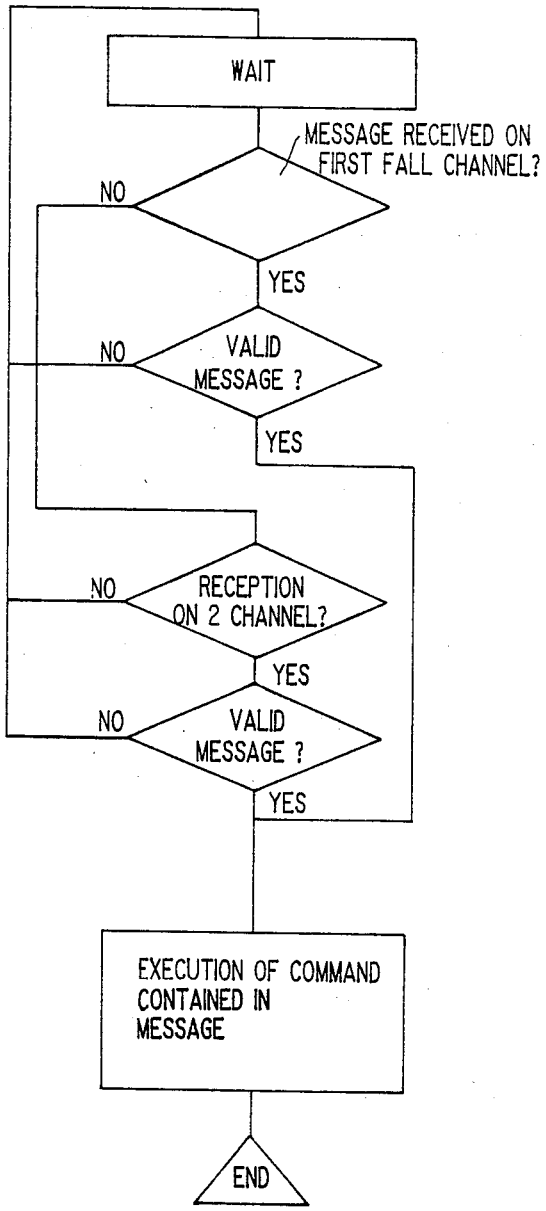

The flow chart of FIG. 3B shows the main operations which are synchronously performed by the electronic means 14 and by the surface station 26. Initially, said electronic means 14 are in a message waiting phase. If a message is received on the first fall channel, e.g. computer 44 will check whether this message is valid by any known checking process. If the message is valid, the corresponding instruction can be performed. The computer which has accepted this message replies by one of the two rise channels that the message has been accepted. However, if the message received on the first fall channel is invalid, the computer on said channel is again in a message waiting phase. If the computer declares that it has received no message, the same operations as described herein before are performed on the second fall channel. If the computer declares that it has received a message, this message is tested to establish whether it is valid. If this message is valid on the second channel, the corresponding instruction is performed and a reply is supplied by the requisite rise channel to indicate that this message has been accepted. However, if the received on the second channel is invalid, the computer on the second channel is returned to a waiting state. The complete communication channel test procedure described hereinbefore applies to either of the computers 44 and 46.

The carrying out of a message by one or other of the computers 44 and 46 on any one of the four possibilities or remote transmission channels takes place in several stages. Firstly the surface station transmits a preparation message and then, following checking of this message by the relevant computer, a performance message is transmitted. This is what is shown in the flow chart of FIG. 3C. The surface station 26 transmits a preparation message. This station then compares the transmitted message with the reply supplied by the computer to check whether the said reply is correct. If the comparison is correct, the station then transmits the instruction performance message. However, if the comparison between the transmitted message and the reply of the apparatus is incorrect, the station transmits on another remote transmission channel and performs the same type of comparison as hereinbefore. If it is not possible to communicate on any of the remote transmission channels, an alarm is given. Conversely, if there is no impossibility to communicate, it is because the apparatus can receive another message and the operations described hereinbefore are recommenced in the same way with the transmission of a new preparation message by station 26.

Figure 3C:
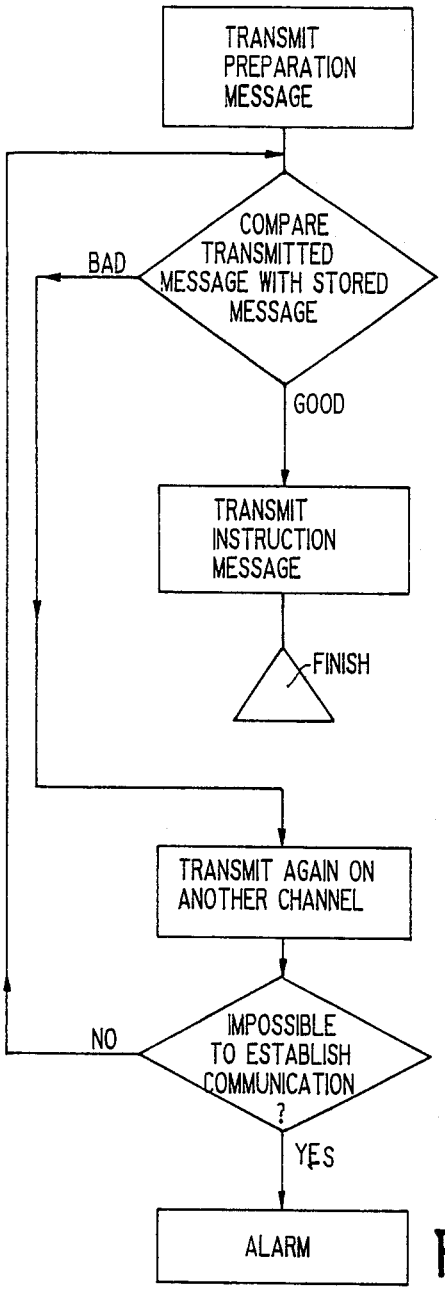
Figure 3D:
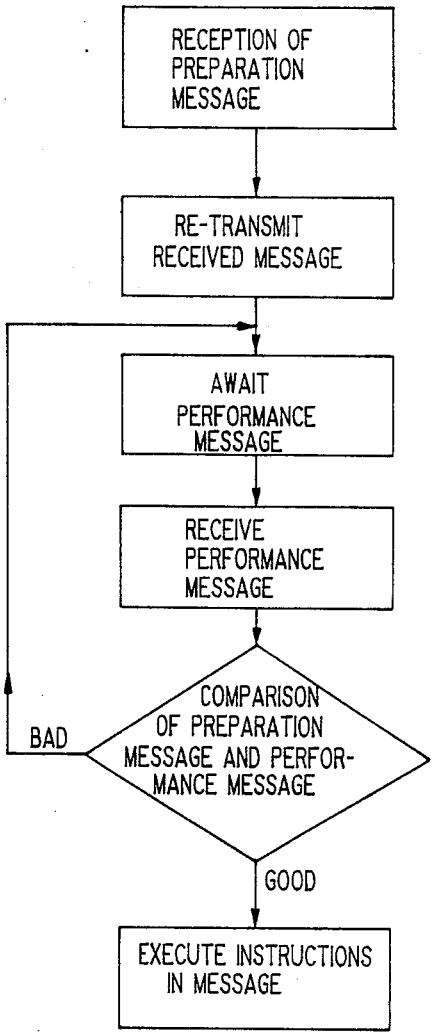

FIG. 3D is a flow chart representing the operations performed by the control means of the apparatus synchronously with the operations described in the flow chart of FIG. 3C. When the control means 14 receive a preparation message by one of the remote transmission channels, said received message is retransmitted to station 26, where it will be tested in the aforementioned manner. This communication channel then waits for the performance message and then receives it. On receiving the performance message, the control channel in question compares the preparation message with the performance message. If this comparison is correct, the instruction corresponding to the performance message is carried out. However, if the comparison is incorrect, the control channel which has received the preparation message is restored to the state of awaiting the performance message. The same operations as those described hereinbefore are then recommenced in the same way: waiting for the performance message, reception of the performance message, comparison of the preparation message with the performance message, etc.

What is claimed is:

1. An apparatus for the control and monitoring of a well head submerged in a liquid comprising:

in a tight submerged enclosure, means for controlling electrovalves for controlling the opening or closing of well head valves;

an electronic system for controlling and monitoring the well head connected to the electrovalve control means and to submerged monitoring sensors;

connecting means connected to the electronic system and to a control and monitoring station on the surface of the liquid medium by a transmission line, which supplies to the electronic system and for the electrovalve control means, control signals for the electrovalve control means and test signals for the electronic system, said line transmitting to the station the signals resulting from these tests, wherein the electronic control and monitoring system comprises two channels, the first of these channels being a control and monitoring channel connected to the electrovalve control means and to the sensors, said first channel being supplied with electric power by connecting means, which are themselves supplied by the line connected to the station, the second channel being a control channel for the electrovalve control means, said second channel being supplied with electric power by connecting means, which are themselves supplied by the line, said second channel and the electrovalve control means being also connected to an autonomous electric power supply source, which is independent of said line and contained in said enclosure, each of the channels, as well as the connection establishing bidirectional communications with the station;

wherein said connecting means comprise an interface connected to the two channels and supply means for receiving the electric power supplied by the line and for providing this power to the interface, to the two channels, as well as to the electrovalve control means the first channel comprising a first computer connected to a first memory, to the sensors by means for the acquisition of the signal supplied by said sensors, to the electrovalve control means, to the interface and to the electric power supply means, the second channel incorporating a second computer connected to a second memory, to the electrovalve control means, to the interface and to the electric power supply means, said second computer, as well as the electrovalve control means also being connected to the autonomous electric power source independent of the electric power supplied by said line, the second computer periodically receiving from the station signals for initializing a regulatable countdown counter, a safety program contained in the memory of this second computer initiating the closure of the valve when the second computer has not received a new initialization signal before the end of the counting down of the counter.

2. An apparatus according to claim 1, wherein the memories of the first and second computers contain programs for controlling the transmission of control, monitoring and test signals between the computers and the station and for initiating an alarm in the case of a transmission incident.

3. An apparatus according to claim 1, wherein the safety program contained in the memory of the second computer initiates a predetermined valve closure procedure in the case of a transmission incident in the connecting means, or the failure of said connecting means to operate, or the breaking of the indicated line.

* * * * *